US007757985B2

(12) United States Patent
Chen

(10) Patent No.: US 7,757,985 B2
(45) Date of Patent: Jul. 20, 2010

(54) SAFETY SHREDDER

(75) Inventor: Liangneng Chen, Shanghai (CN)

(73) Assignee: Aurora Office Equipment Co., Ltd., Jiading, Shanghai (CN)

( * ) Notice: Subject to any disclaimer, the term of this patent is extended or adjusted under 35 U.S.C. 154(b) by 96 days.

(21) Appl. No.: 11/980,176

(22) Filed: Oct. 30, 2007

(65) Prior Publication Data

US 2009/0134252 A1 May 28, 2009

(51) Int. Cl.
*B02C 23/04* (2006.01)

(52) U.S. Cl. ..... 241/37.5; 241/100

(58) Field of Classification Search ..... 241/37.5, 241/100, 236

See application file for complete search history.

(56) References Cited

U.S. PATENT DOCUMENTS

| | | | | |
|---|---|---|---|---|
| 4,411,391 | A | 10/1983 | Crane | |
| 4,817,877 | A | 4/1989 | Itoh et al. | |
| 4,842,205 | A | 6/1989 | Araki et al. | |
| 5,044,270 | A | 9/1991 | Schwelling | |
| 5,969,310 | A * | 10/1999 | Schwelling | 200/61.41 |
| 6,065,696 | A | 5/2000 | Tsai | |
| 6,116,528 | A * | 9/2000 | Schwelling | 241/36 |
| 6,676,050 | B2 | 1/2004 | Chang | |
| 6,682,006 | B2 | 1/2004 | Lee | |
| 6,964,386 | B2 | 11/2005 | Ho | |
| 7,083,131 | B2 | 8/2006 | Ting | |
| 7,414,212 | B2 * | 8/2008 | Huang | 200/334 |
| 2006/0054725 | A1 | 3/2006 | Matlin | |
| 2006/0219827 | A1 | 10/2006 | Matlin et al. | |
| 2007/0012808 | A1 * | 1/2007 | Kao | 241/37.5 |
| 2007/0034725 | A1 | 2/2007 | Duh | |
| 2007/0246581 | A1 | 10/2007 | Matlin et al. | |
| 2008/0006728 | A1 * | 1/2008 | Zhang | 241/37.5 |
| 2008/0105772 | A2 | 5/2008 | Matlin | |
| 2008/0156912 | A1 * | 7/2008 | Huang | 241/37.5 |
| 2008/0164351 | A1 * | 7/2008 | Wang | 241/37.5 |
| 2008/0169369 | A1 * | 7/2008 | Wang | 241/37.5 |

FOREIGN PATENT DOCUMENTS

| | | |
|---|---|---|
| WO | WO 2009/058225 | 5/2009 |

* cited by examiner

*Primary Examiner*—Faye Francis
(74) *Attorney, Agent, or Firm*—Franklin E. Gibbs; Erick P. Wolf; John P. O'Rourke

(57) ABSTRACT

Active protection system for a paper shredder, which includes an upper cover and a shedder plate on the upper cover. The paper shredder plate includes a touch structure, which engagingly interacts with a preferential power supply switch. When closed, the shredder plate prevents contact with the shredding blade. When opened, the shredder plate both initiates shredder normal operation, and prevents feeding of unexpected items into the shredder making accidental contact with the shredding blade. When an unexpected item contacts the safety structure, beneath the paper shredder plate, the protection system switches off the shredder power supply.

14 Claims, 6 Drawing Sheets

SAFETY SHREDDER

FIELD OF THE INVENTION

The present invention relates to a safety mechanism for a paper shredder and, in particular, to a safety assurance mechanism for a paper shredder feed opening.

BACKGROUND OF THE INVENTION

Currently, paper shredder feed openings can be divided generally into two types: an open structure and a sliding-plate structure. In an open structure feed opening, a user can directly feed paper into a paper feed opening for shredding. In a sliding plate structure, a user needs to expose the paper feed opening, prior to feeding in paper. Neither structure is connected directly to a circuit capable of cutting off power to the paper shredder. Therefore, neither paper feed opening type preferentially switches off power to the paper shredder, so as to actively protect users from accidentally feeding, for example, parts of their bodies, or their personal belongings, into a paper shredder feed opening.

SUMMARY OF THE INVENTION

The circuit design and the mechanical structure of the present invention, namely a shredder paper feed opening protection system, includes a paper shredder upper cover and a paper shredder plate. The shredder upper cover has a longitudinally-oriented opening, and the paper shredder plate being selectively positioned to cover the feed opening, so that the paper feed opening may be either open or closed. The paper shredder plate can be configured with one of a touch structure or a preferential power supply switch and the paper shredder upper cover can be configured with the other of a preferential power supply switch or a touch structure. The touch structure and the preferential power supply switch are configured to engagingly interact with each other, so that the shredder power supply (1) can be switched off when the paper shredder plate is selectively positioned to close the paper feed opening; (2) can be switched on when the paper shredder plate is selectively positioned to open, or uncover, the paper feed opening, and (3) is switched off again when unexpected items are introduced into the paper feed opening, deflecting the selectively positioned paper shredder plate. The paper shredder upper cover and the paper shredder plate can be configured to be an integrated element, or may be configured as separate elements.

Therefore, the preferential power supply switch has a dual protection function: when the paper shredder plate is closed, the entire circuit is not electrically conductive—this is the first-level protection; while when the paper shredder plate is opened during normal operation, the paper shredder plate will switch off the power supply if there are any unexpected items fed, or that accidentally fall down, into the paper feed opening. The falling action will cause a noticeable force that enables the preferential power supply switch to switch off power supply—this is the second-level protection.

In the circuit of the present paper feed opening protection system for a paper shredder, a disconnection switch has a first-level priority, and is introduced electrically before a safety switch and a paper-full switch. The preferential power supply switch is electrically positioned relative to other shredder operational switches, to preferentially switch off the shredder power supply, having first-level priority to protect a user by providing a shredder protection. The preferential power supply switch is different from other shredder operational switches, such as a standard safety switch, or a paper-full switch, because the preferential power supply switch interacts with the touch structure. In other words, the present invention adopts a preferential power supply switch that provides more active protection to users with the aid of a mechanical structure, the touch structure.

The touch structure and the preferential power supply switch can be integrated into a one-circuit disconnection device that serves as a protection system. The protection system acts, after switching on the shredder power supply, as passive conduit whenever the paper feed opening is selectively opened to receive paper for shredding. The protection system actively switches off the shredder power supply whenever the paper feed opening is selectively opened and an unexpected item is fed into the paper feed opening. The protection system acts switches off the shredder power supply, whenever the paper feed opening is selectively closed by the paper shredder plate.

The paper shredder upper cover and the paper shredder plate refer to any separate or integrated structures able to seal the paper feed opening. The paper shredder plate and the paper shredder upper cover are connected such that the former can move separately relative to the latter. The touch structure can be a cam disposed on the paper shredder plate; corresponding to the cam, the preferential power supply switch is disposed on a corresponding position of the paper shredder upper cover. The cam and the preferential power supply switch are configured to interact with each other to control the shredder power supply.

The opening is an indented opening disposed on the paper shredder upper cover; the paper shredder plate locates at the indented opening; the cam is disposed on the bottomside of the paper shredder plate; and the preferential power supply switch is disposed in the reverse side of the paper shredder upper cover.

The cam comprises a fundamental cam and a cam point on the fundamental cam. The fundamental cam is fixed on the paper shredder plate, and the cam point interacts with the touch point of the preferential power supply switch.

Shaft bases are fixed on the two longitudinally opposite sides on the reverse side the paper shredder upper cover. The shaft bases each have a main base body, and a shaft protruding from the main base body. Corresponding to the shaft base, protruding blocks are fixed on the opposite sides of the bottomside of the paper shredder plate. Within each protruding block, a shaft hole is opened to accommodate the shaft.

Each shaft base further includes a protrusion located under the respective shaft, with each protrusion having a respective protruding point, oriented towards the corresponding shaft. A closing detent point and a working detent point are provided on each protruding block, to engage each of the protruding points on a protrusion corresponding to a protrusion block.

The main base bodies each have through-holes. A pole is positioned on either side, and at either end, along a longitudinal axis on the reverse side of the paper shredder upper cover. The through-holes and the poles are connected together by screws that go through both. The fundamental cam is fixed to the protruding block, such that the cam is indirectly fixed to the paper shredder plate. As a result, the paper shredder plate also may be a constituent of the touch structure.

The paper shredder plate can be configured on opposite sides of a transverse axis of the bottomside, with one transverse side of the shredder plate having a paper stopper extending downwards and inwards, relative to the paper feed opening, and the other transverse side being formed with an indented pressing area in the middle section of the outer surface.

The preferential power supply switch also includes through-holes. The reverse side of the paper shredder upper cover has poles at a location corresponding to the touch structure. The through-holes and the poles are connected together by screws that go through both.

Beneficial features of the present invention include:

1. A paper shredder plate that enables a touch structure and a preferential power supply switch to interact with each other, resulting in a simple protection system, which can be inexpensive to manufacture.

2. A touch structure that selectively controls the opening and closing of the paper shredder plate, and, interacting with the preferential power supply switch, selectively controls the switching on and off of the power supply to the paper shredder. Moreover, in case of an abnormal opening, that is, a deflection, of the paper shredder plate, the touch structure will cause the power supply to be switched off to prevent any part of a user's body, or his/her personal belongings, to enter the paper feed opening.

3. A protruding block having an adjustable closing detent point and an adjustable working detent point, either one of which detent points matches the protruding point on the corresponding shaft base, which permits convenient, accurate closing and opening of the paper shredder plate.

BRIEF DESCRIPTION OF THE DRAWINGS

The invention is generally shown by way of reference to the accompanying drawings in which.

DETAILED DESCRIPTION OF THE INVENTION

The following embodiment will explain the technical details of the present invention to make it more easily understood.

Figure 3:
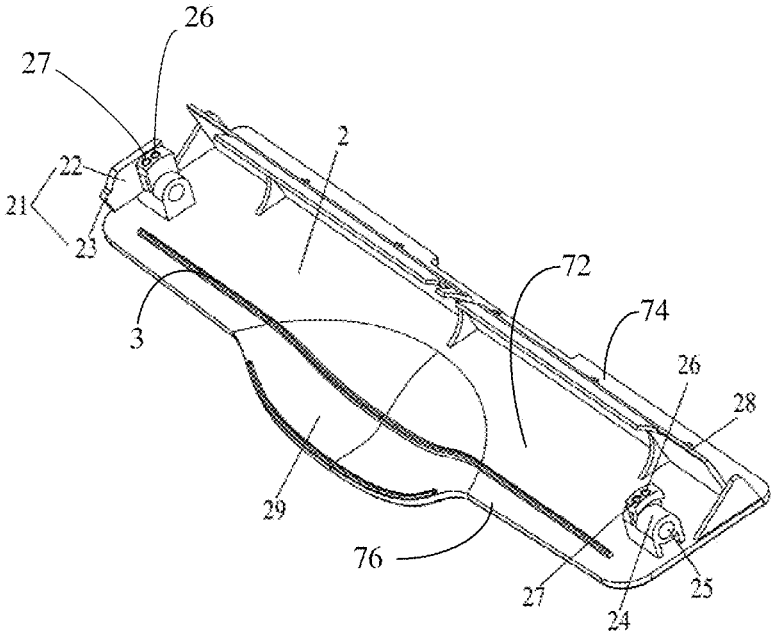
FIG. 3 shows the 3-Dimensional structure of the cover plate of the embodiment shown in FIG. 1.
Figure 4:
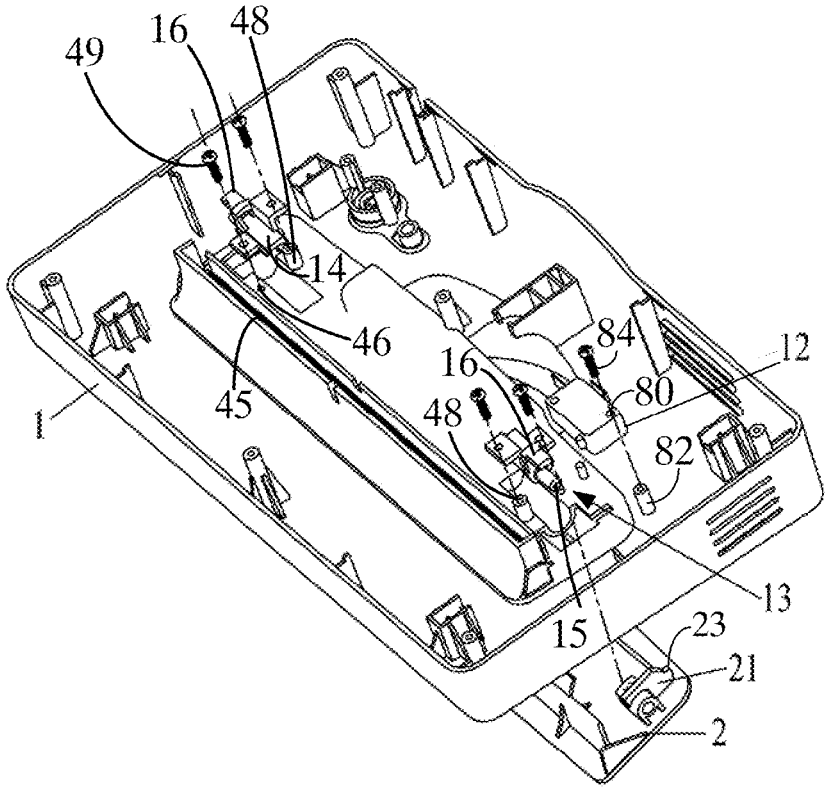
FIG. 4 shows the 3-Dimensional structure of the assembling process of the embodiment shown in FIG. 1.

Referring to FIGS. 1, 3, 4, and 11, the present invention relates to a paper feed opening protection structure generally at 100 for a paper shredder, comprising a paper shredder upper cover 1 and a paper shredder plate 2. As illustrated in FIGS. 3 and 4, both the paper shedder upper cover 1 and the paper shredder plate 2 can be generally rectangular and oriented to a longitudinal axis and a transverse axis. The paper shredder upper cover 1 has an obverse side 60 and a reverse side 62 with a longitudinally-disposed paper feed opening 45 extending through obverse side 60 to reverse side 62. The paper shredder plate 2 has a topside 70 and a bottomside 72, and is located proximately to the paper feed opening 45 at the obverse side 60 of the paper shredder upper cover 1. In some embodiments, the paper shedder upper cover 1 and the paper shredder plate 2 may be integrated. In other embodiments, the paper shedder upper cover 1 may be separate from the paper shredder plate 2.

The paper shredder plate 2 is configured with a touch structure 40, and the paper shredder upper cover 1 is correspondingly configured with a preferential power supply switch 12. Alternately, the touch structure 40 can be disposed on paper shredder upper cover 1, and a preferential power supply switch 12 can be disposed on paper shredder plate 2. The touch structure 40 and the preferential power supply switch 12 are designed to interact with each other, and can be constituents of a paper feed opening protection system 100. The paper shredder plate 2 is selectively positioned on the paper feed opening 45. System 100 operates such that when the paper shredder plate 2 is selectively positioned to close paper feed opening 45, the touch structure 40 interacts with the preferential power supply switch 12 to switch off the shredder power supply 50. On the other hand, when the paper shredder plate 2 is selectively positioned to open, or expose, the paper feed opening 45, the touch structure 40 interacts with the preferential power supply switch 12 to switch on the shredder power supply 50. However, when the paper shredder plate 2 is selectively positioned to open, or expose, the paper feed opening 45 and an unexpected item (i.e., other than paper to be shredded) is fed into the paper feed opening 45, the unexpected item forces up, that is, deflects, the paper shredder plate 2.

Deflecting paper shredder plate 2 actively switches off the shredder power supply 50 by the interaction of the touch structure 40 on preferential power supply switch 12. Thus, the present invention provides user protection by preferentially selecting between enabling or disabling the shredder power supply 50, while the paper feed opening 45 is accessible and open. In addition, the present invention provides protection by switching off the shredder power supply 50 both when the paper shredder plate 2 is selectively positioned to close the paper feed opening 45 is closed; and, during normal operation, when an unexpected item enters the paper feed opening 45, and deflects the paper shredder plate 2.

As indicated above, the preferential power supply switch 12 has a dual protection function. First-level protection is provided when the paper shredder plate 2 is selectively positioned to close the paper feed opening 45, making it inaccessible, the shredder power supply 50 is switched off and is not electrically conductive. Second-level protection is provided when the paper shredder plate 2 is selectively positioned to open the paper feed opening 45, and the paper shredder plate 2 will switch on the shredder power supply 50 to perform normal operation. In the event an unexpected item is introduced into the paper feed opening 45, a noticeable force will result, which deflects paper shredder plate 2. The deflection causes paper shredder plate 2 to interact with the preferential power supply switch 12 and to switch off the power supply 50.

The touch structure 40 and the preferential power supply switch 12 can be integrated into a single-circuit disconnection device that serves as the protection structure 100, which actively switches off the power supply whenever an unexpected item is fed into the paper feed opening 45, and which functions reversely as a passive conducting device while feeding paper through the paper feed opening 45. The preferential power supply switch 12 is a preferential disconnection device. Different from an ordinary safety switch, or a paper-full switch, whose function is realized, for example, by adopting a flip-flop in a circuit of a paper shredder, the preferential power supply switch 12 has first-level priority in power supply circuit 50 to protect a user.

The paper shredder upper cover 1 and the paper shredder plate 2 refer to separate structures able to seal the paper feed opening 45, when the paper shredder plate 2 is selectively positioned to close paper feed opening 45. The paper shredder upper cover 1 and the paper shredder plate 2 also may be integrated. The paper shredder plate 2 and the paper shredder upper cover 1 are connected such that the former can move separately, and be selectively positioned, relative to the latter.

The touch structure 40 comprises a cam 21 disposed on the paper shredder plate 2. Corresponding to the cam 21, the preferential power supply switch 12 is disposed on a corresponding position of the paper shredder upper cover 1. The cam 21 and the preferential power supply switch 12 are configured to interact with each other. That is, when the paper shredder plate 2 is selectively positioned to open, or expose, paper feed opening 45, the cam 21 interacts with the preferential power supply switch 12 to switch on the shredder power supply 50. When there is an unexpected item fed into the paper feed opening 45, touch structure 40 is deflected upward and the cam 21 interacts with the preferential power supply switch 12 to actively switch off the shredder power supply 50. Also, when the paper shredder plate 2 selectively positioned to close the paper feed opening 45, the cam 21 interacts with the preferential power supply switch 12 to switch off the shredder power supply 50.

In one of the embodiments of the present invention, the paper feed opening 45 is included in a longitudinally-oriented recess 11 that is formed in the obverse side 60 of the paper shredder upper cover 1. The paper shredder plate 2 is positioned at the recess 11. The cam 21 is disposed on the bottomside 72 of the paper shedder plate 2; and the preferential power supply switch 12 is disposed on the reverse side 62 of the paper shredder upper cover 1, proximate to cam 21.

Figure 1:
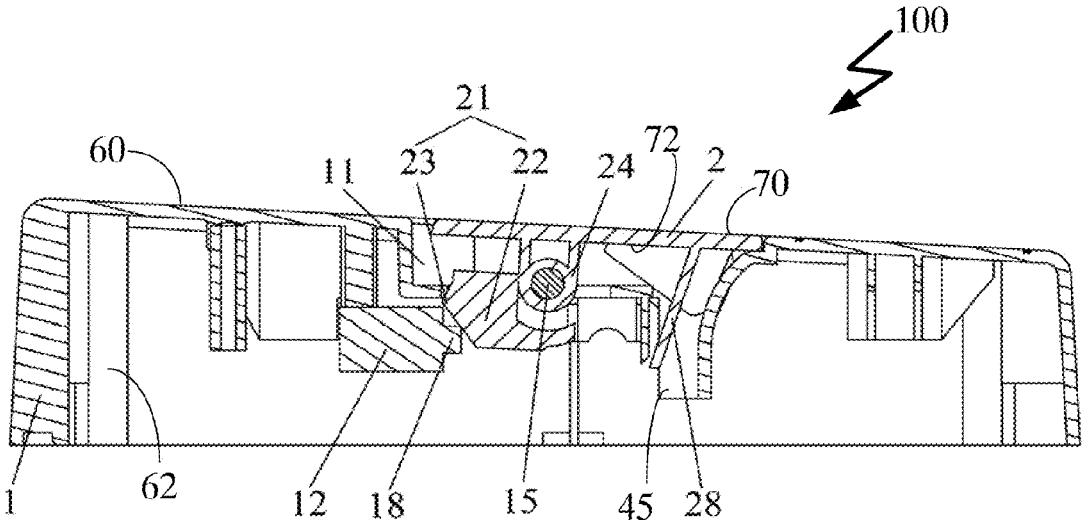
FIG. 1 shows the cross-section of an embodiment of the present invention.

As illustrated in FIGS. 1, 3, and 4, the cam 21 comprises a fundamental cam 22 and a cam point 23 on the fundamental cam 22. The fundamental cam 22 is coupled to the bottomside 72 of paper shredder plate 2, and the cam point 23 interacts with the touch point 18 of the preferential power supply switch 12. That is, during the process of opening the paper shredder plate 2, the cam point 23 of the cam 21 interacts with the switch touch point 18 to switch on the preferential power supply switch 12, and to switch on shredder power supply 50. When an unexpected item is fed into paper feed opening 45, the cam point 23 of the cam 21 interacts with the touch point 18 of the preferential power supply switch 12 to actively switch off the power supply 50. When the paper shredder plate 2 is closed, the cam point 23 of the cam 21 again interacts with the touch point 18 of the preferential power supply switch 12, and cuts off power supply 50. In other words, when the touch point 18 of the preferential power supply switch 12 engagingly interacts with the cam 21 of the paper shredder plate 2, the power supply 50 can be switched on or off.

Figure 2:
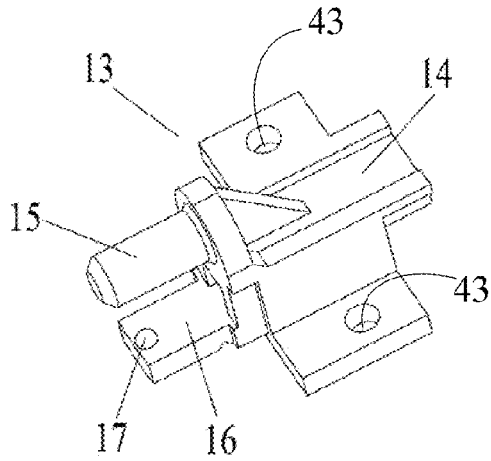
FIG. 2 shows the 3-Dimensional structure of the shaft base of the embodiment shown in FIG. 1.
Figure 5:
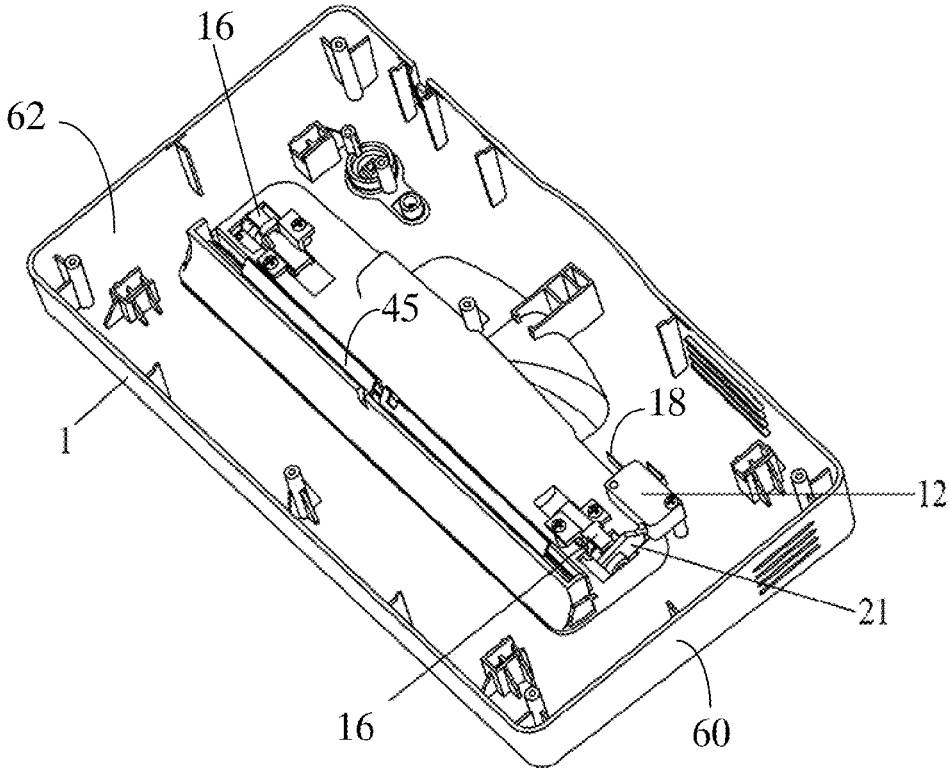
FIG. 5 shows the 3-Dimensional structure for afinished assembly shown in FIG. 4.
Figure 6:
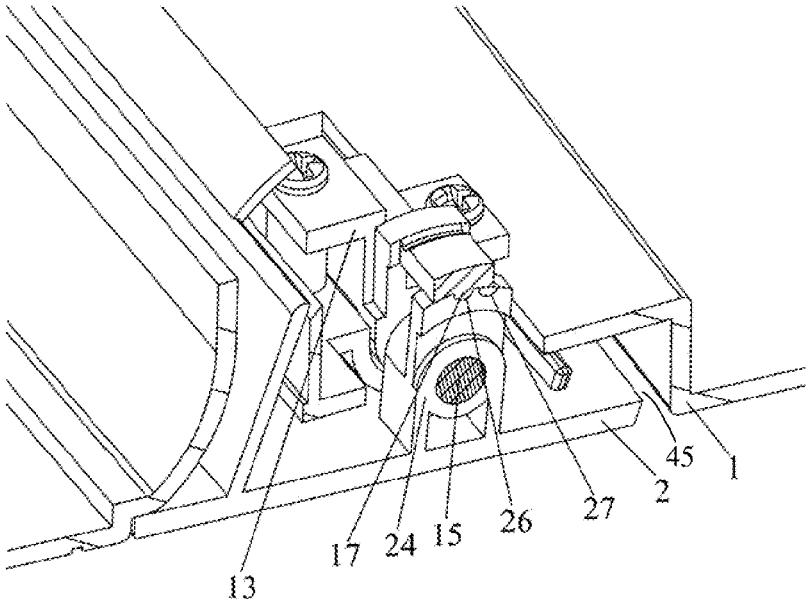
FIG. 6 shows the 3-Dimensional structure for apart of a cross-section of the embodiment shown in FIG. 5.
Figure 7:
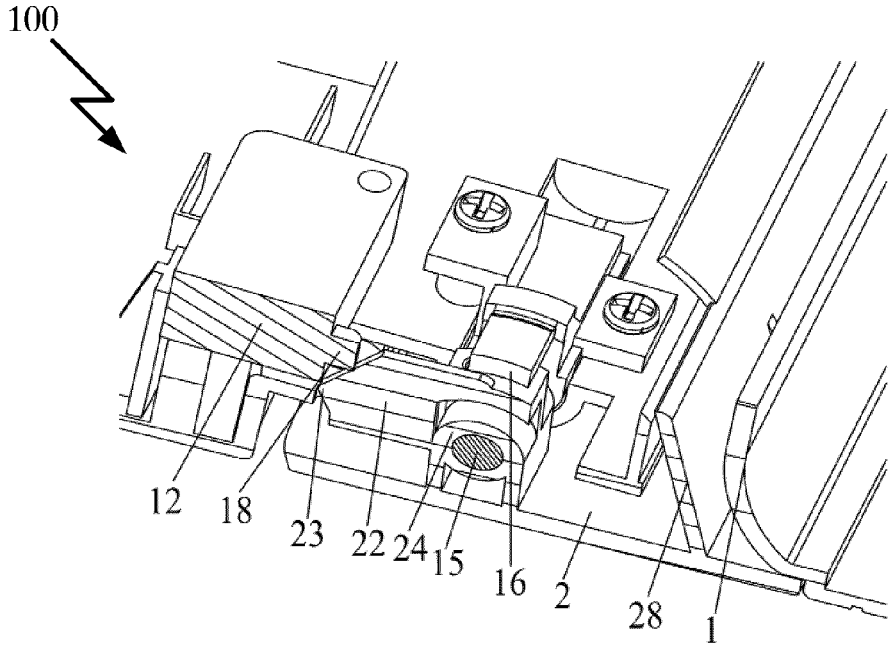
FIG. 7 shows the 3-Dimensional structure for apart of another cross-section of the embodiment shown in FIG. 5.

Referring to FIGS. 2, 4, and 5, a shaft base 13 is fixed on each of the two longitudinally opposite ends of the reverse side 60 of the paper shredder upper cover 1. Each shaft base 13 respectively includes a main base body 14, and a shaft 15 protruding from the main base body 14. Each main base body 14 also has through-holes 43. Corresponding to each shaft base 13 is a protruding block 24 fixed on the respective longitudinally opposite sides of the bottomside 72 of the paper shredder plate 2. Within each protruding block 24, a shaft hole 25 is opened to accommodate the shaft 15.

Each shaft base 13 further includes a protrusion 16 located under, and parallel to, the shaft 15, with each of the protrusions 16 being provided with a respective protruding point 17. Protruding point 17 is oriented to face the corresponding shaft 15. Each respective protruding block 24 on paper shredder plate 2 further includes a closing detent 26 or a working detent point. Each of the protruding points 17 on the respective upper cover shaft bases 13, are positioned to releasably engage one of the closing detent point 26 or working detent point 27 on a respective protruding block 24. The fundamental cam 22 is fixed to the protruding block 24, with the cam 21 being indirectly coupled to the paper shredder plate 2.

Each main base body 14 of each shaft base 13 has through-holes 43. Opposite ends on the reverse side 62 of the paper shredder upper cover 1 are configured with poles 48. Each through-hole 43 and pole 48 are connected together by a respective screw 49*a* that goes though both.

As illustrated in FIG. 3, the paper shredder plate 2 can be configured on opposite sides of a transverse axis of the bottomside, with one transverse side of the shredder plate having a paper stopper extending downwards and inwards, relative to the paper feed opening, and the other transverse side being formed with an indented pressing area in the middle section of the outer surface to facilitate pressing. When the paper shredder plate 2 is lifted and paper feed opening 45 is selectively opened, the paper stopper 28 faces downwards so that the paper fed to be shredded can smoothly reach the shredding blade (not shown). Sealing band 3 can facilitate sealing the paper feed opening 45, and also can facilitate deflecting paper shredder plate 2 should sealing band 3 come into contact with an unexpected item during shredder operation. Thus, sealing band 3 also can be an element of touch structure 40.

Returning to FIG. 4, the preferential power supply switch 12 includes through-holes 80. The paper shredder upper cover 1 has poles 82 at the place corresponding to the power supply switch 12. The through-holes 80 and the poles 82 are connected together by screws 84 that go through both.

Referring to FIGS. 4 and 5, the above mentioned parts are assembled in the following manner: screwing the preferential power supply switch 12 on the reverse side 62 of the paper shredder upper cover 1; inserting the shaft 15 on the respective shaft base 13 into the corresponding shaft hole 25 in the respective protruding block 24 on the bottomside 72 of the paper shredder plate 2; and screwing the shaft base 13 on the reverse side 62 of the paper shredder upper cover 1. The finished assembly is shown in FIGS. 5, 6, 7, 8 and 9.

Figure 10:
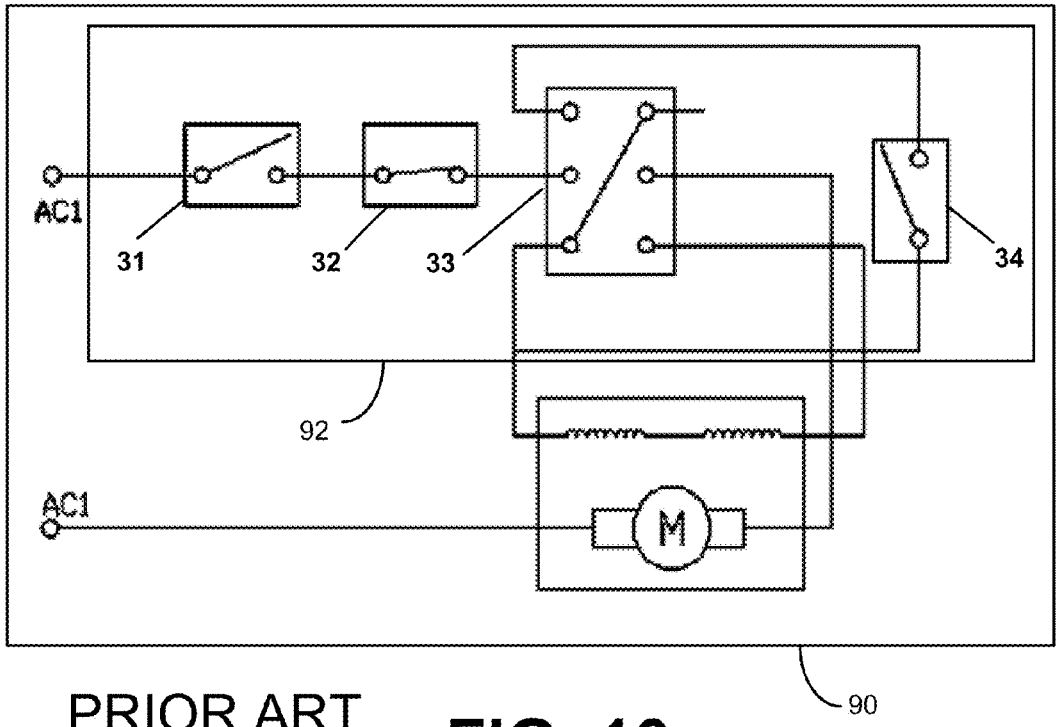
PRIOR ART FIG. 10
FIG. 10 shows the priority of a protection circuit in prior art.
Figure 11:
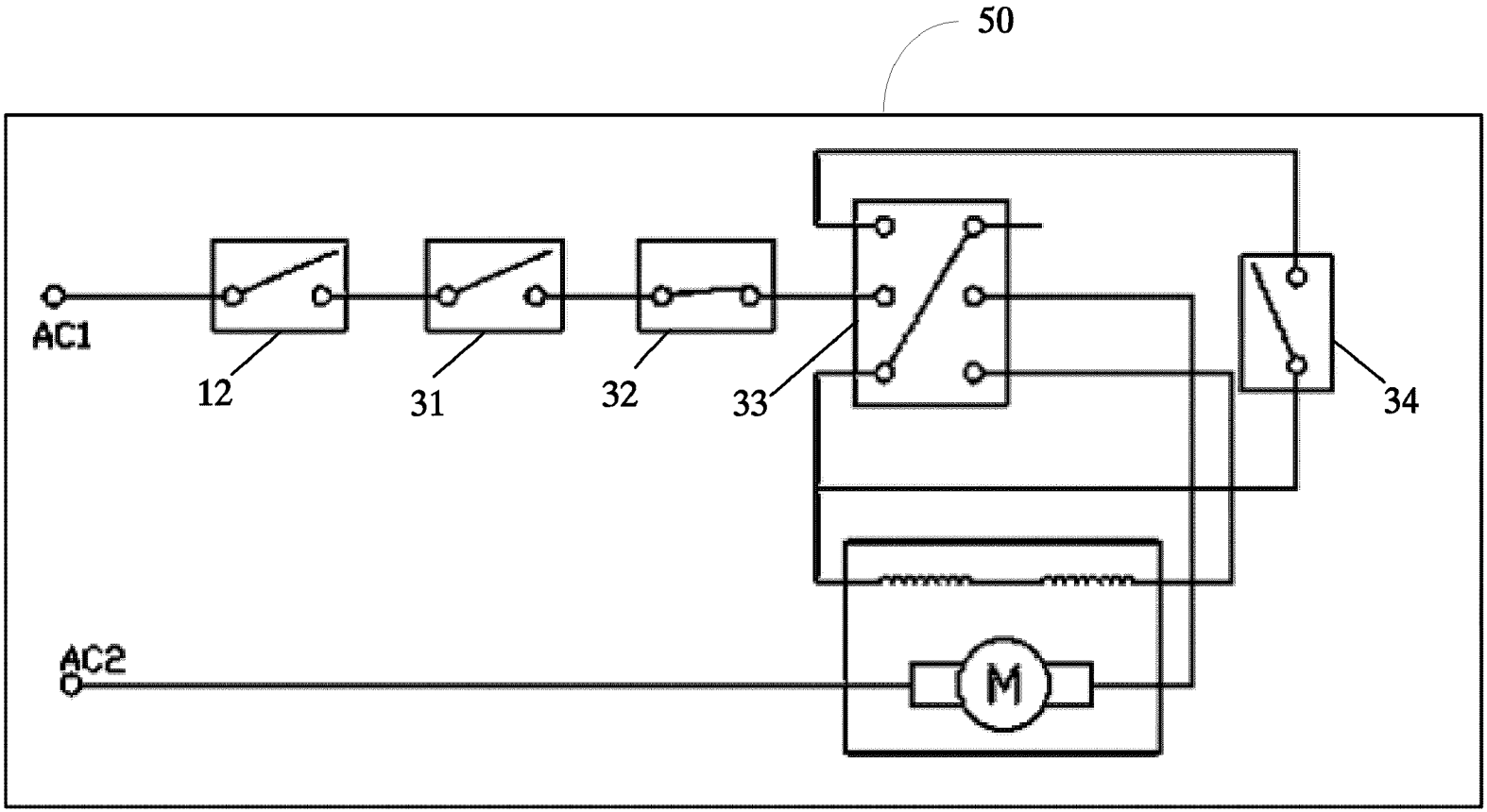
FIG. 11 shows the priority levels of the preferential power supply switch of the present utility

Referring to FIG. 10, a common protection circuit 90 for the power supply 92 of a prior art paper shredder is roughly composed of a safety switch 31 (trash can touch switch), a paper-full switch 32 (or a photic-controlled paper-full switch), a power supply flip-flop 33 (or a microcomputer-controlled inching switch) and a paper-sensitive switch 34. The safety switch 31 and the paper-full switch 32 have the first-level priority to switch off the power supply: when the paper shredder detaches from a trash can, the safety switch 31 reacts, and when the trash can is full, the paper-full switch 32 reacts; this is the normal way to protect a user. In FIG. 11, a circuit of in accordance with the present invention, namely a paper feed opening protection system for a paper shredder, includes a disconnection switch which has first-level priority. Preferential power supply switch 12 is such a disconnection switch, which is electrically positioned before the safety switch 31 and the paper-full switch 32, and which switch 12, along with the aid of a mechanical touch structure 40, provides more active protection to users.

Referring back to FIGS. 1, 7, 8, and 9, the cam 21 on the paper shredder plate 2 disengages the preferential power supply switch 12 when the paper shredder plate 2 is closed. Because the safety power switch 12 has the first-level priority to switch off the power supply 50, preferential power supply switch 12 controls the power supply 50 of the entire paper shredder. Therefore, the entire paper shredder is switched off and cannot function. Moreover, the paper feed opening is closed and hence is safe to users.

Figure 8:
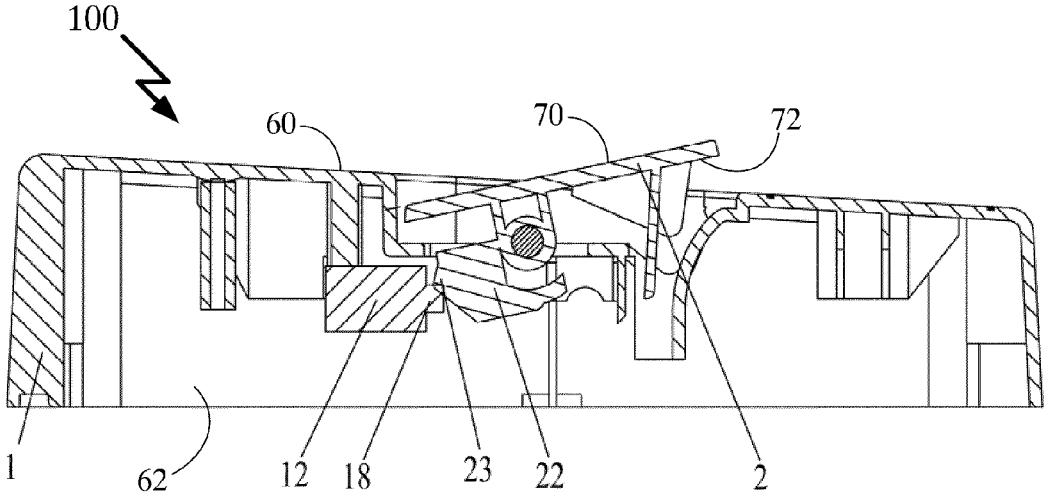
FIG. 8 shows the cross-section of an open paper shredder plate of the embodiment shown in FIG. 1.

Referring to FIG. 8, when the paper shredder plate 2 is pressed down for paper shredding, the cam 21 on the paper shredder plate 2 presses the preferential power supply switch 12. In particular, the cam point 23 presses the touch point 18 of preferential power supply switch 12, thereby the power supply is switched on and the paper shredder is placed in electrical stand-by. A user then is able to shred paper through the paper feed opening 45 which is exposed by the selectively positioned paper shredder plate 2.

Figure 9:
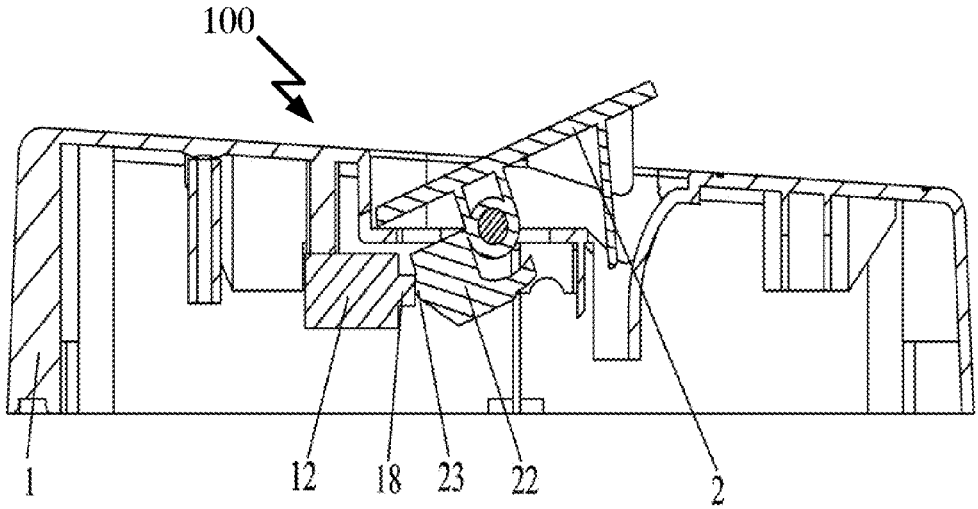
FIG. 9 shows the cross-section of the paper shredder plate in abnormal status of the embodiment shown in FIG. 1.

Referring to FIG. 9, when the shredder is operating, in the case where a child or a user accidentally feeds an unexpected item, such as a part of his/her body, or a tie, or other article of clothing won by him/her, the paper shredder plate 2 will further deflect upwards to cause the cam 21 of the paper shredder plate 2 to disengage the safety power supply 12, or in particular, to cause the cam point 23 to lose contact with the touch point 18. As mentioned above, since the safety power switch 12 has the first-level priority to switch off the power supply, the entire paper shredder is switched off and cannot function. Therefore, users and their personal belongs are protected. Moreover, due to the adoption of an adjustable closing detent point 26 and an adjustable working detent point 27 on each protruding block 24 on the bottomside 72 of the paper shredder plate 2, the protruding point 17 of the shaft base 13 is adjusted to be accommodated in the closing detent point 26 of the paper shredder plate 2 when the paper shredder plate 2 is closed, and to be accommodated in the closing detent point 27 of the paper shredder plate 2 when the paper shredder plate 2 is opened.

In summary, the present invention is simply designed and easy to use, and features both active protection and dual protection. While this specification describes the present invention in reference to the above specific embodiments, the present invention can be modified and transformed under its substantial spirit and within its substantial scope. Therefore, the specification and the drawings thereof are provided as descriptions of a preferred embodiment rather than limitations.

What is claimed is:

1. A paper feed opening protection system for a paper shredder, comprising:

a paper shredder upper cover having an obverse side and a reverse side, the paper shredder upper cover having a paper feed opening there through;

a paper shredder plate having a topside and a bottomside, wherein the bottomside of the paper shredder plate is disposed proximate to the obverse side of the paper shredder upper cover, and wherein the paper shredder plate is selectively positioned to one of fully cover and fully uncover the paper feed opening;

a touch structure configured to mechanically respond to contact therewith; and a preferential power supply switch configured to preferentially control a shredder power supply for performing a shredder protection in response to the touch structure mechanically responding;

wherein the paper shredder upper cover is configured with one of the touch structure or the preferential power supply switch, and the paper shredder plate is configured with the other of the touch structure or the preferential power supply switch, and wherein the touch structure and the preferential power supply switch are configured to engagingly interact to control the paper shredder power supply.

2. The protection system of claim 1, wherein the paper shredder plate is selectively positioned to uncover the paper feed opening, wherein the selective position of the paper shredder plate is deflected relative to the paper feed opening, representing an unexpected item being inserted into the paper feed opening, and wherein the shredder plate engagingly interacts the preferential power supply switch to switch off the shredder power supply.

3. The protection system according to claim 1, wherein the paper shredder upper cover and the paper shredder plate are formed into an integrated structure.

4. The protection system according to claim 1, wherein the touch structure and the preferential power supply switch are configured as an integrated power disconnection system.

5. The protection system according to claim 1, wherein the paper shredder upper cover and the paper shredder plate are formed into separate structures.

6. The protection system according to claim 5, wherein the touch structure and the preferential power supply switch are configured as an integrated power disconnection system.

7. The protection system according to claim 6, further comprising:

a cam having a fundamental cam with a cam point extending therefrom, and coupled to the bottomside of the paper shredder plate, wherein the preferential power supply switch is positioned on the paper shredder upper cover to engagingly interact with the cam point when the paper shredder plate is selectively positioned on the paper feed opening.

8. The protection system according to claim 1, further comprising:

a cam having a fundamental cam with a cam point extending therefrom, and coupled to the bottomside of the paper shredder plate, wherein the preferential power supply switch is positioned on the paper shredder upper cover and includes a touch point to engagingly interact with the cam point when the paper shredder plate is selectively positioned relative to the paper feed opening;

a main base body connected to the reverse side of the paper shredder upper cover, and having a shaft extending from the main base body and a protrusion extending from the main base body and set apart from the shaft; and a protruding block fixed to the bottomside of the paper shredder plate and having a shaft hole opened to accommodate the shaft of the main base body, wherein the protrusion has a protrusion point oriented towards the shaft, wherein the protruding block further includes a closing detent point and a working detent point, wherein the protrusion point is configured to engage with one of the closing detent point or the working detent point, as the shaft is rotated in the shaft hole and the paper shredder plate is selectively positioned.

9. The protection system according to claim 7, further comprising:

a main base body connected to the reverse side of the paper shredder upper cover, and having a shaft extending from the main base body and a protrusion extending from the main base body and set apart from the shaft; and a protruding block fixed to the bottomside of the paper shredder plate and having a shaft hole opened to accommodate the shaft of the main base body;

wherein the protrusion has a protrusion point oriented towards the shaft, wherein the protruding block further includes a closing detent point and a working detent point, wherein the protrusion point is configured to engage with the closing detent point or the working detent point, as the shaft is rotated in the shaft hole and the paper shredder plate is deflected.

10. The protection system, according to claim 9, wherein the paper shredder plate is selectively positioned to uncover the paper feed opening, and wherein engagingly interacting switches on the shredder power supply.

11. The protection system, according to claim 9, wherein the paper shredder plate is selectively positioned to cover the paper feed opening, and wherein engagingly interacting switches off the shredder power supply.

12. The protection system, according to claim 9, wherein the paper shredder plate further comprises a first transverse side configured at its inner surface with a paper stopper that extends downwards and inwards relative to the paper feed opening, and a second transverse side formed with an indented pressing area in the middle section of said outer surface.

13. The protection system, according to claim 1, wherein the paper shredder plate is selectively positioned to uncover the paper feed opening, and wherein engagingly interacting switches on the shredder power supply.

14. The protection system, according to claim 1, wherein the paper shredder plate is selectively positioned to cover the paper feed opening, and wherein engagingly interacting switches off the shredder power supply.

* * * * *